US012317944B1

(12) United States Patent
Draper

(10) Patent No.: US 12,317,944 B1
(45) Date of Patent: Jun. 3, 2025

(54) CLIP ASSEMBLY FOR A NECKTIE

(71) Applicant: David Michael Draper, Indian Trail, NC (US)

(72) Inventor: David Michael Draper, Indian Trail, NC (US)

( * ) Notice: Subject to any disclaimer, the term of this patent is extended or adjusted under 35 U.S.C. 154(b) by 0 days.

(21) Appl. No.: 18/466,147

(22) Filed: Sep. 13, 2023

Related U.S. Application Data

(60) Provisional application No. 63/406,204, filed on Sep. 13, 2022.

(51) Int. Cl.
*A41D 25/00* (2006.01)

(52) U.S. Cl.
CPC ..... *A41D 25/003* (2013.01)

(58) Field of Classification Search
CPC .... A41D 25/003; A41D 25/10; A41D 25/025; A44B 6/00
See application file for complete search history.

(56) References Cited

U.S. PATENT DOCUMENTS 2,931,045 A 4/1960 France
3,050,737 A 8/1962 Scully
3,221,343 A 12/1965 Phillips et al.
3,423,762 A * 1/1969 Sweeney ..... A41D 25/025 2/153
3,890,678 A * 6/1975 Leonard, Jr. ..... A41D 25/10 63/8
4,337,539 A * 7/1982 Najarian ..... A41D 25/12 2/153
6,021,522 A * 2/2000 Najarian ..... A41D 25/025 2/153
6,490,763 B2 12/2002 Tamura
D667,752 S 9/2012 Leclerc
9,854,860 B1 * 1/2018 Katz ..... A41D 25/10
2018/0146728 A1 * 5/2018 Katz ..... A41D 27/08

* cited by examiner

*Primary Examiner* — Gloria M Hale
(74) *Attorney, Agent, or Firm* — John Rizvi; John Rizvi, P.A.—The Patent Professor ®

(57) ABSTRACT

A clip assembly to fasten a looped item to a necktie comprising: a main body, where the main body is comprised of two portions, a first portion and a second portion, where the first portion and the second portion engage a knot of the necktie; a hinge pivotably securing the first portion and the second portion, where the hinge moves the first portion and the second portion between a first position, and a second position; and a securing portion affixed to the main body, where the securing portion fastens the looped item against a knot of the necktie.

18 Claims, 14 Drawing Sheets

CLIP ASSEMBLY FOR A NECKTIE

CROSS-REFERENCE TO RELATED APPLICATIONS

This application claims the benefit of U.S. Provisional Patent Application Ser. No. 63/406,204, filed on Sep. 13, 2022, which is incorporated by reference herein in its entirety.

FIELD OF THE INVENTION

The present invention relates generally to a clip assembly, and more particularly, to a clip assembly for a necktie.

BACKGROUND OF THE INVENTION

As with any other sentimental object, ring is often a very personal items that carries with it special significance and/or meaning. For example, wedding ring announces to the world that the wearer is married, engagement rings announces to the world that the wearer is engaged, school ring may remind the wearer of their Alma Mater, sport ring may remind the wearer of their glory days playing a particular sport, etc.

Many medical conditions, for example Arthritis, psoriasis, etc., cause fingers and joints to swell. These medical conditions make it painful and uncomfortable for people to wear their special rings.

Accordingly, there is need for a solution to at least one of the aforementioned problems. For instance, there is an established need for a device that can allow a person to securely and proudley wear their precious ring despite any medical condition they may have.

SUMMARY OF THE INVENTION

The present invention is directed to a clip assembly which can be used to securely display a ring or any other looped item on a necktie.

In a first implementation of the invention, a clip assembly to fasten a looped item to a necktie is disclosed, The clip assembly may comprise a main body, where the main body is comprised of two portions, a first portion and a second portion, where the first portion and the second portion engage a knot of the necktie; a coupling means pivotably securing the first portion and the second portion, where the coupling means moves the first portion and the second portion between a first position, and a second position; and a securing portion affixed to the main body, where the securing portion fastens the looped item against a knot of the necktie.

In another aspect of the invention, the first portion may be a central portion, where the central portion may extend between an upper end and a lower end, and where the second portion may be a coupling member, where the coupling member may extend between a top end and a bottom end.

In another aspect of the invention, the coupling member and the central portion may be coupled together with the coupling means, where the coupling means is a hinge.

In another aspect of the invention, the central portion may include a securing device at the lower end, where the securing device faces the coupling member.

In another aspect of the invention, the securing device may include a securing end, where the securing end hooks upward from the securing device.

In another aspect of the invention, the coupling member may include a narrow elongated body, where the narrow elongated body inserts into the knot of the necktie.

In another aspect of the invention, the bottom end of the coupling member may include a lip, where the lip protrudes beyond a perimeter of the bottom end.

In another aspect of the invention, the lip may be flush against a backside of the coupling member.

In an alternative aspect of the invention, the first portion may a plurality of wings extending from a central portion, and the second portion may be a necktie coupling member pivotably coupled with the central portion.

In an alternative aspect of the invention, the securing portion may comprise a looped item coupling member pivotably coupled with the central portion.

In another aspect of the invention, the looped item may be a ring.

In another aspect of the invention, the first position may be a release position.

In another aspect of the invention, the second position may be a secure position.

In another aspect of the invention, the clip assembly may be made from one of at least a metallic, plastic or polymer material.

According to the present invention a method of use for a clip assembly to secure a looped item to a knot of a necktie may comprise the steps of:

- positioning a main body of the clip assembly against the knot, where the main body includes a first portion and a second portion;
- coupling the clip assembly to the knot by positioning the first portion against a backside of the knot, and engaging the second portion within the knot;
- threading the necktie through a looped item;
- sliding the looped item along an elongated portion of the neck tie to meet the knot;
- inserting the looped item within the clip assembly in an open position, where the open position positions the first portion away from the second portion;
- positioning a securing portion of the clip assembly against the looped item; and
- engaging the securing portion of the clip assembly against a band of the looped item where the securing portion prevents the looped item from sliding off the knot.

Another aspect of the method of use for the present invention may engage the backside of the knot with the first portion, where the first portion includes a pair of wings extending from a central portion.

Another aspect of the method of use for the present invention may open the clip assembly by pivotally moving the first portion away from the second portion.

Another aspect of the method of use for the present invention, may rest the first portion against the backside of the knot, where the first portion may include a central portion extending between an upper end and a lower end, and may insert the second portion within the knot, where the second portion may include a coupling member extending between a top end and a bottom end along an elongated body.

Another aspect of the method of use for the present invention, may lock the looped item onto the clip assembly, by engaging the looped item to the lower end of the central portion with a securing device.

A clip assembly to fasten a looped item to a necktie may comprise:

- a main body, where the main body is comprised of two portions, a first portion and a second portion, where the first portion is positioned against a backside of a knot of the necktie, and where the second portion inserts into the knot of the necktie;

a coupling means pivotably securing the first portion and the second portion, where the coupling means moves the first portion and the second portion between a first position, and a second position;

where the first position separates the first portion from the second portion to receive the knot of the necktie, and where the second position closes the first portion to be adjacent to the second portion when the knot is engaged; and a securing portion affixed to the main body, where the securing portion fastens the looped item against the knot of the necktie.

In a second aspect, the looped item coupling member may be a ring coupling member.

In another aspect, the necktie coupling member may pivot from secure position to release position.

In another aspect, the clip assembly may be coupled with a necktie when the necktie coupling member is secure position.

In another aspect, release position may be position away from the secure position.

In another aspect, the looped item coupling member may pivotss from closed position to open position.

In another aspect, the clip assembly may be coupled with a looped item when the looped item coupling member is in the closed position.

In another aspect, open position may be position away from closed position.

In another aspect, the necktie coupling member may be pivotably coupled with an upper portion of the main body.

In another aspect, the looped item coupling member may be pivotably coupled with a lower portion of the main body.

In an alternative aspect, a method is disclosed. The method may comprise providing a necktie with a knot, coupling the necktie coupling member with the knot, positioning at least a portion of each of the side wings within one or more folds of the knot, threading the necktie through a looped item, and coupling the looped item coupling member with the looped item.

In another aspect, coupling the looped item coupling member with the looped item may comprise pivoting the looped item coupling member from an open position to locked position.

In another aspect, the open position may be position away from locked position.

In another aspect, coupling the necktie coupling member with the knot may comprise pivoting the necktie coupling member from release position to secure position.

In another aspect, the release position may be positioned away from secure position.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed towards an assembly for displaying a looped item on a necktie as described in more detail below.

Figure 1:
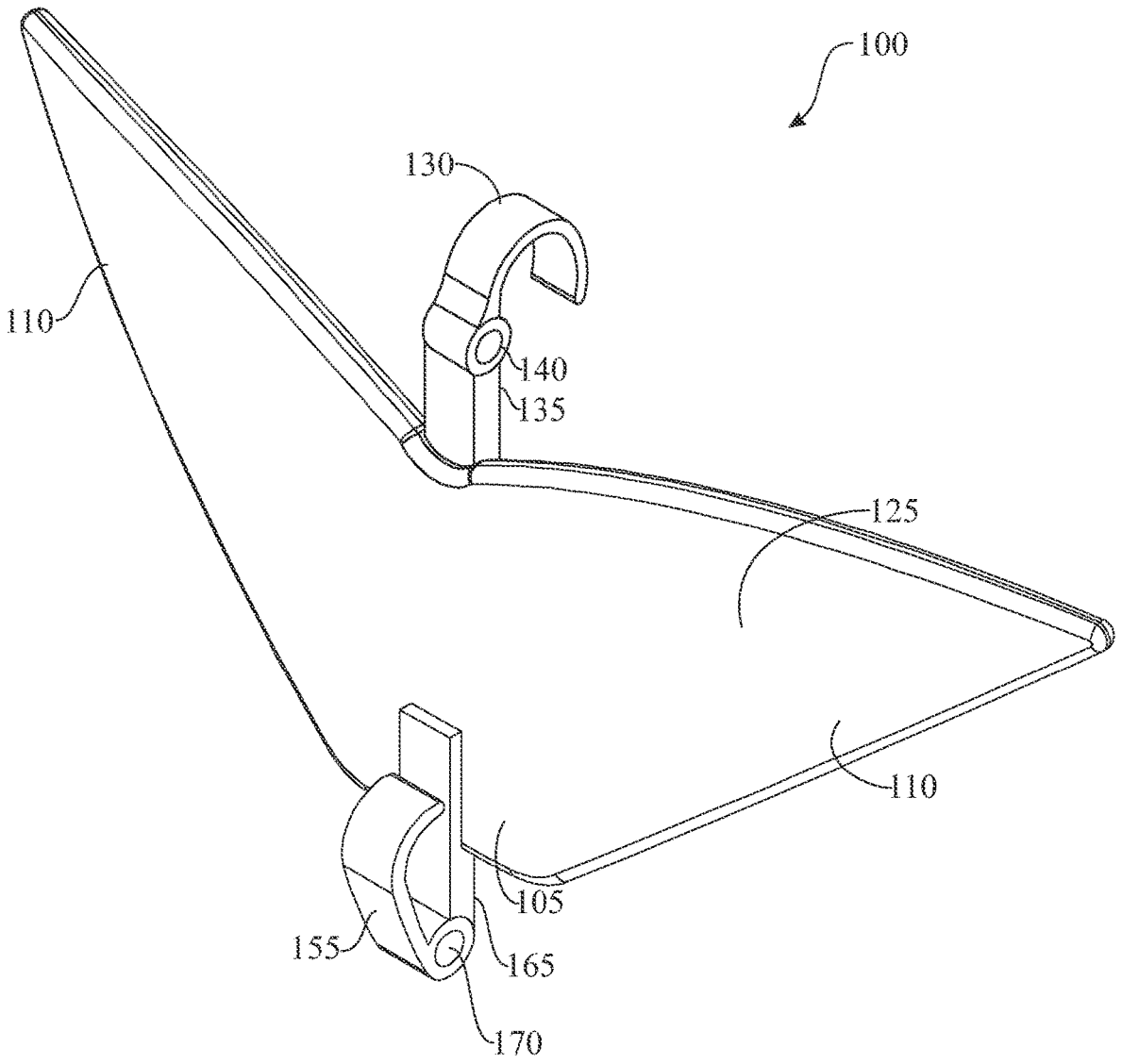
FIG. 1 presents a front isometric view of a clip assembly in accordance with a first embodiment of the present invention.
Figure 2:
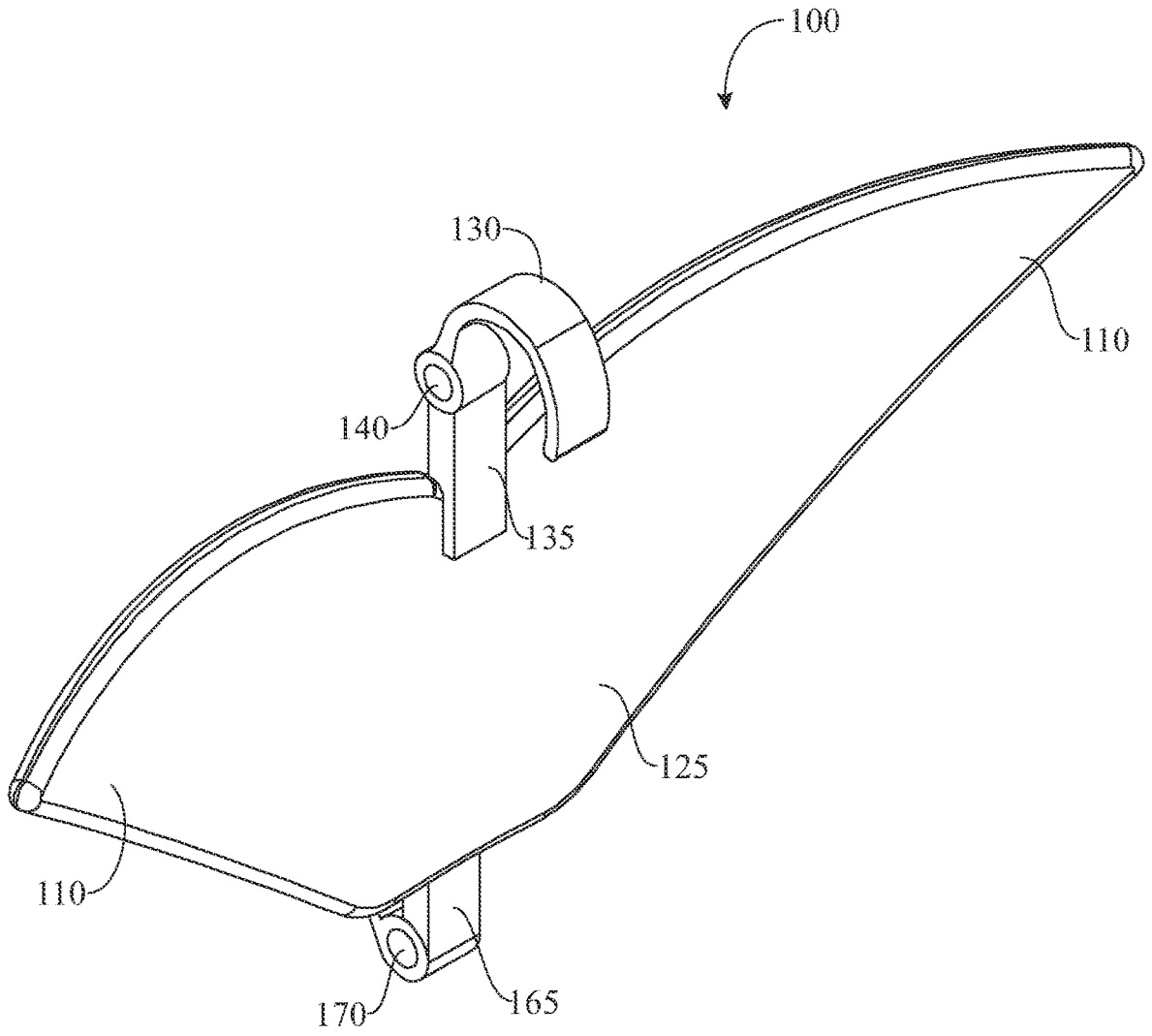
FIG. 2 presents a rear isometric view of the clip assembly illustrated in FIG. 1.
Figure 3:
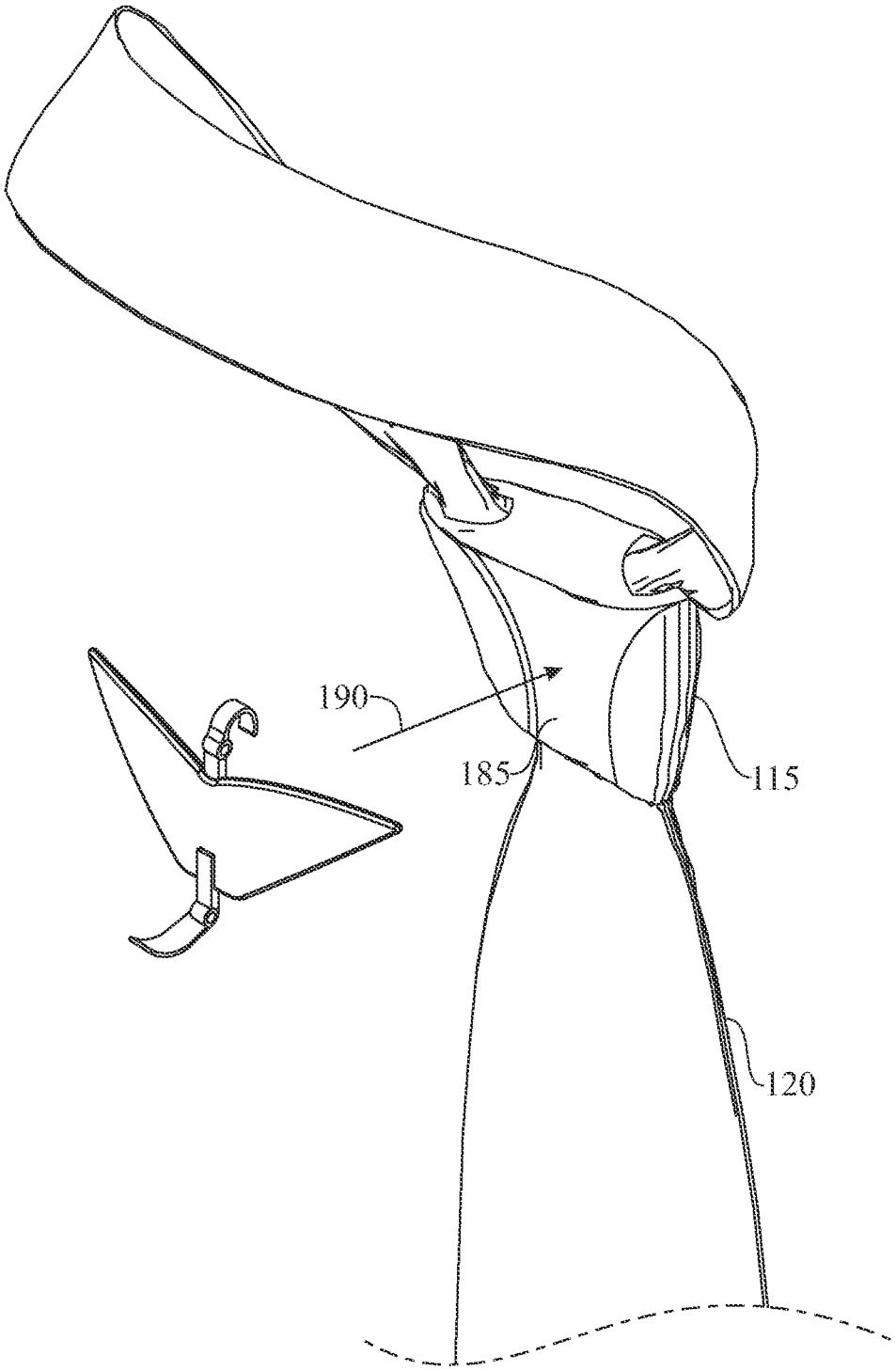
FIG. 3 presents an exploded isometric view of the clip assembly illustrated in FIG. 1 and a necktie.

Referring initially to FIGS. 1-6, a clip assembly 100 is illustrated in accordance with a first embodiment of the present invention. The assembly 100 may include a main body 105. The main body 105 may be shaped to match shape of a knot 115 formed by a necktie 120 shown in FIGS. 3-4 and 6. As shown in FIGS. 1-2, the body 105 may include a pair of side wings 110 extending outwards from a central portion 125. The main body 105 may be formed using, for example, metal, plastic and/or polymer material.

Figure 4:
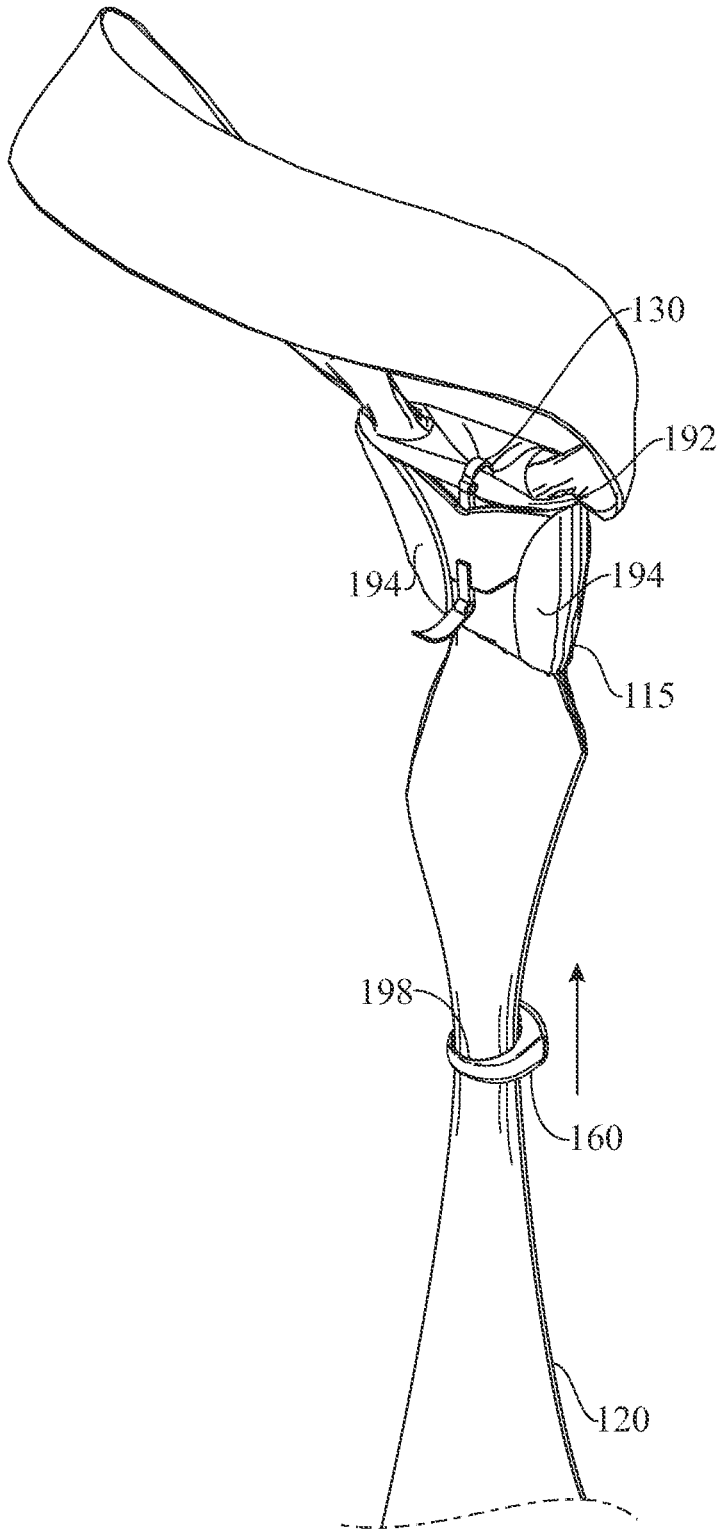
FIG. 4 presents an assembled isometric view of the clip assembly illustrated in FIG. 1 with the necktie.

According to some embodiments, the assembly 100 may include a necktie coupling member 130. The necktie coupling member 130 may be applied to or looped over the knot 115 as shown in FIG. 4. The necktie coupling member 130 may be pivotably coupled directly with the central portion 125 or it may be pivotably coupled with a protrusion 135 extending from the central portion 125. The necktie coupling member 130 may pivot about pin 140 shown in FIGS. 1-2. According to some embodiments, the necktie coupling member 130 may pivot from a first (secure) position to a second (release) position and back again as shown by arrow 145 in FIG. 5. The first (secure) position may be when the necktie coupling member 130 is applied to the knot 115 as shown in FIG. 4. The second (release) position may be when the necktie coupling member 130 is positioned away from the first (secure) position as shown by dotted lines 150 in FIG. 5. The necktie coupling member 130 may be retained in the first (secure) position by friction between the necktie coupling member 130 and the pin 140.

Figure 5:
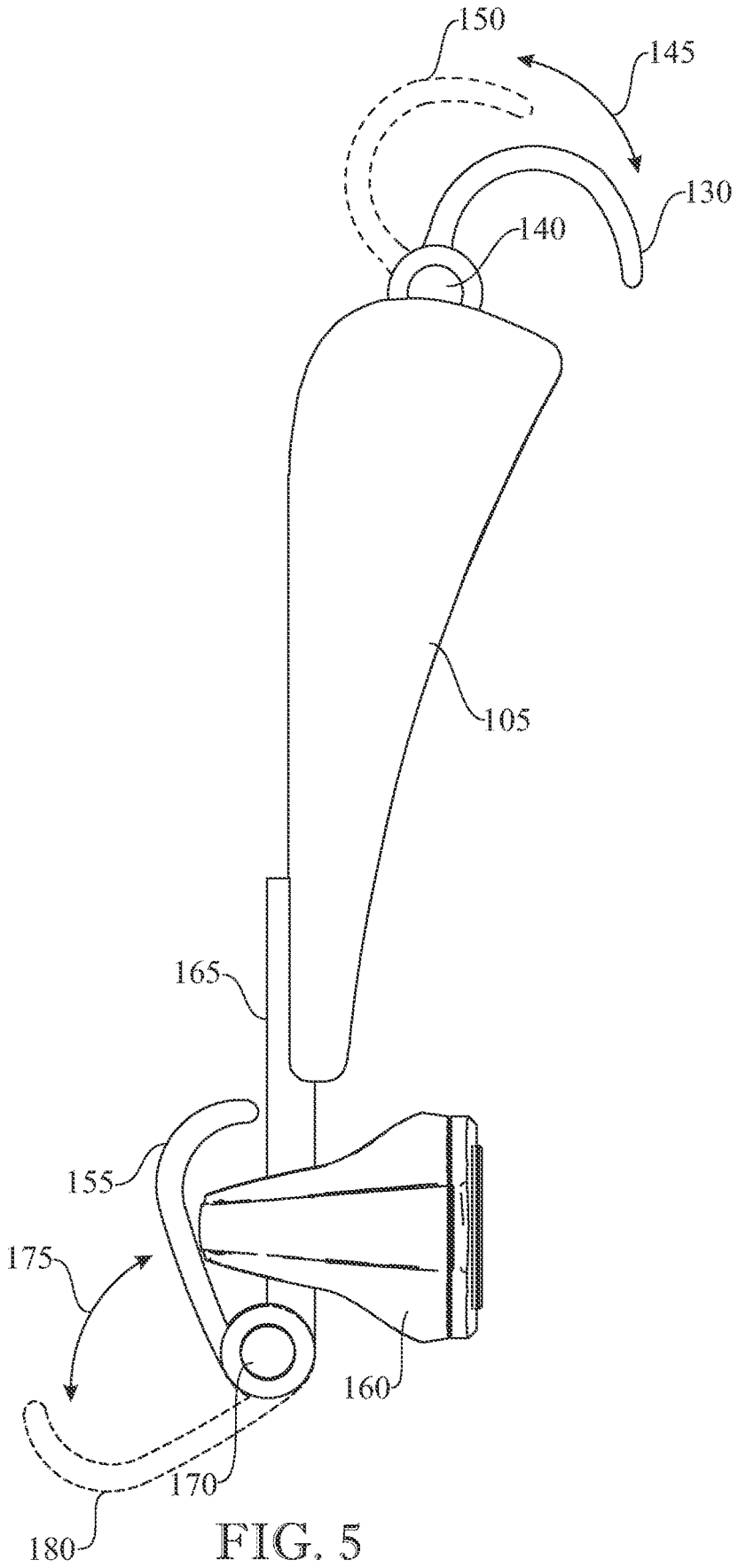
FIG. 5 presents a side view of the clip assembly illustrated in FIG. 1 with a looped item.
Figure 6:
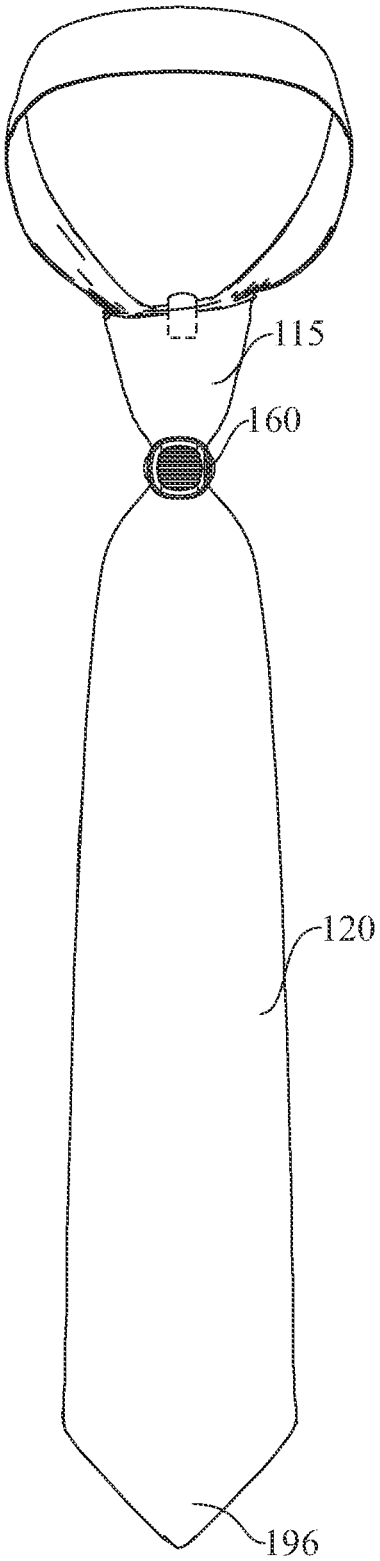
FIG. 6 presents a front view of the tie illustrated in FIG. 4 with the looped item illustrated in FIG. 5.

According to the first embodiment, the assembly 100 may include a looped item coupling member 155 at a lower end of the main body 105. The looped item coupling member 155 may be applied to the looped item 160 as shown in FIG. 5. The looped item coupling member 155 may be pivotably coupled directly with the central portion 125 or it may be pivotably coupled with a protrusion 165 extending from the central portion 125. The looped item coupling member 155 may pivot about pin 170 shown in FIGS. 1-2. According to some embodiments, the looped item coupling member 155 may pivot from first (closed) position to a second (open) position and back again as shown by arrow 175 in FIG. 5. The first (closed) position is when the looped item coupling member 155 is applied to the looped item 160 and prevents removal of the looped item 160 from the assembly 100 as shown in FIG. 5. The second (open) position is when the looped item coupling member 155 is positioned away from the first (closed) position as shown by dotted lines 180 in FIG. 5 and allows removal of the looped item 160 from the assembly 100. The looped item coupling member 155 may be retained in the first (closed) position by friction between the looped item coupling member 155 and the pin 170. The looped item 160 may be, for example, ring, brooch, or any other item with a through aperture.

Figure 7:
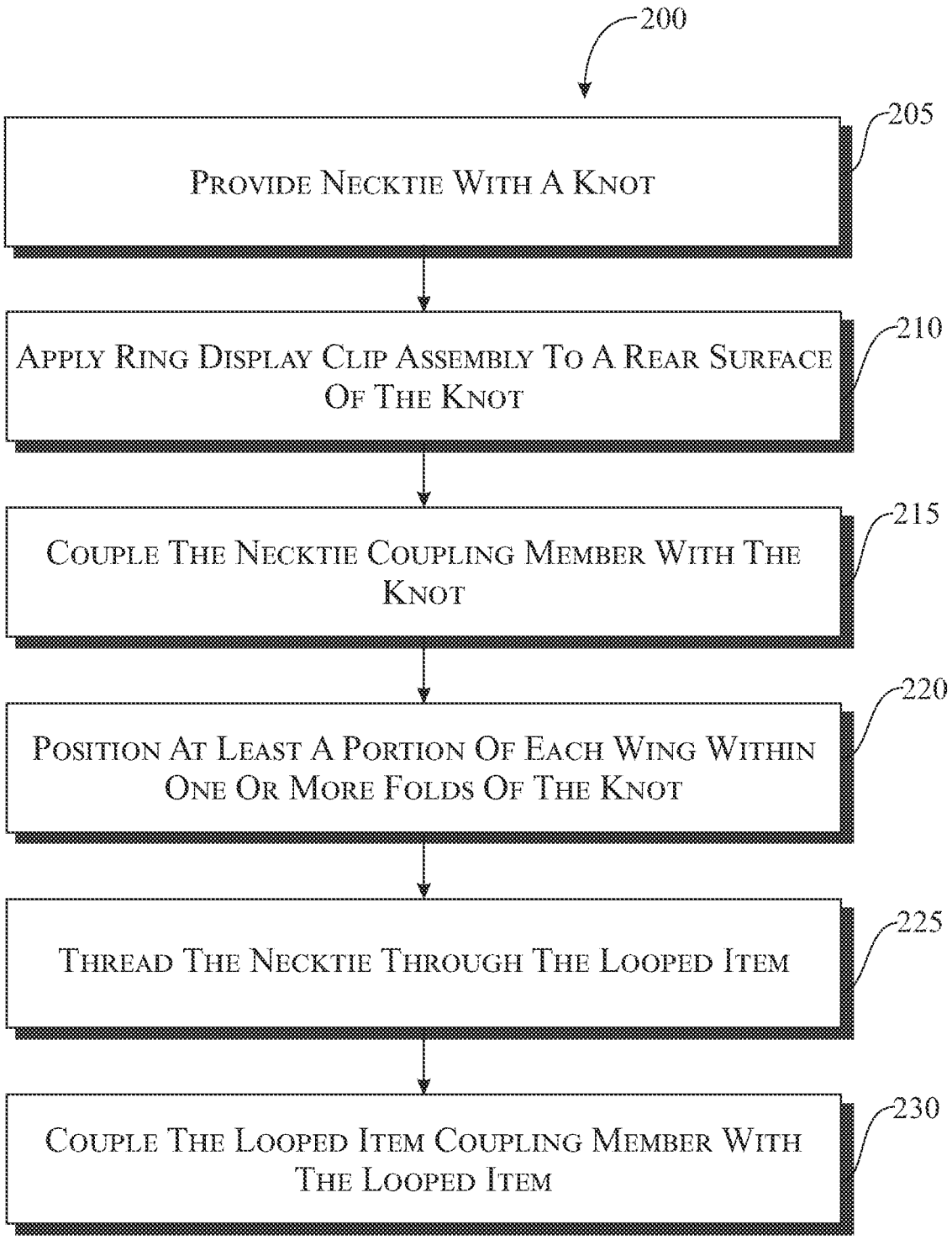
FIG. 7 presents a process in accordance with some embodiments presently disclosed.

FIG. 7 depicts a flow diagram 200 showing attaching the looped item 160 to the necktie 120. Referring to FIG. 7, in some embodiments, at 205, user provides a necktie 120 with the knot 115. The knot 115 may be formed while the user is wearing the necktie 120 around user's neck. At 210, the clip assembly 100 may be applied to a rear surface 185 of the knot 115 as shown by arrow 190 in FIG. 3. At 215, the necktie coupling member 130 may pivot into the first (secure) position to couple with an upper portion 192 of the knot as shown in FIG. 4. At 220, position at least a portion of each wing 110 within one or more folds 194 of the knot 115 as shown in FIG. 4. At 225, thread a free end 196 of the necktie 120 through an aperture 198 of the looped item 160. At 230, pivot the looped item coupling member 155 into the first (closed) position to couple with the looped item 160 of the knot as shown in FIG. 5.

Figure 8:
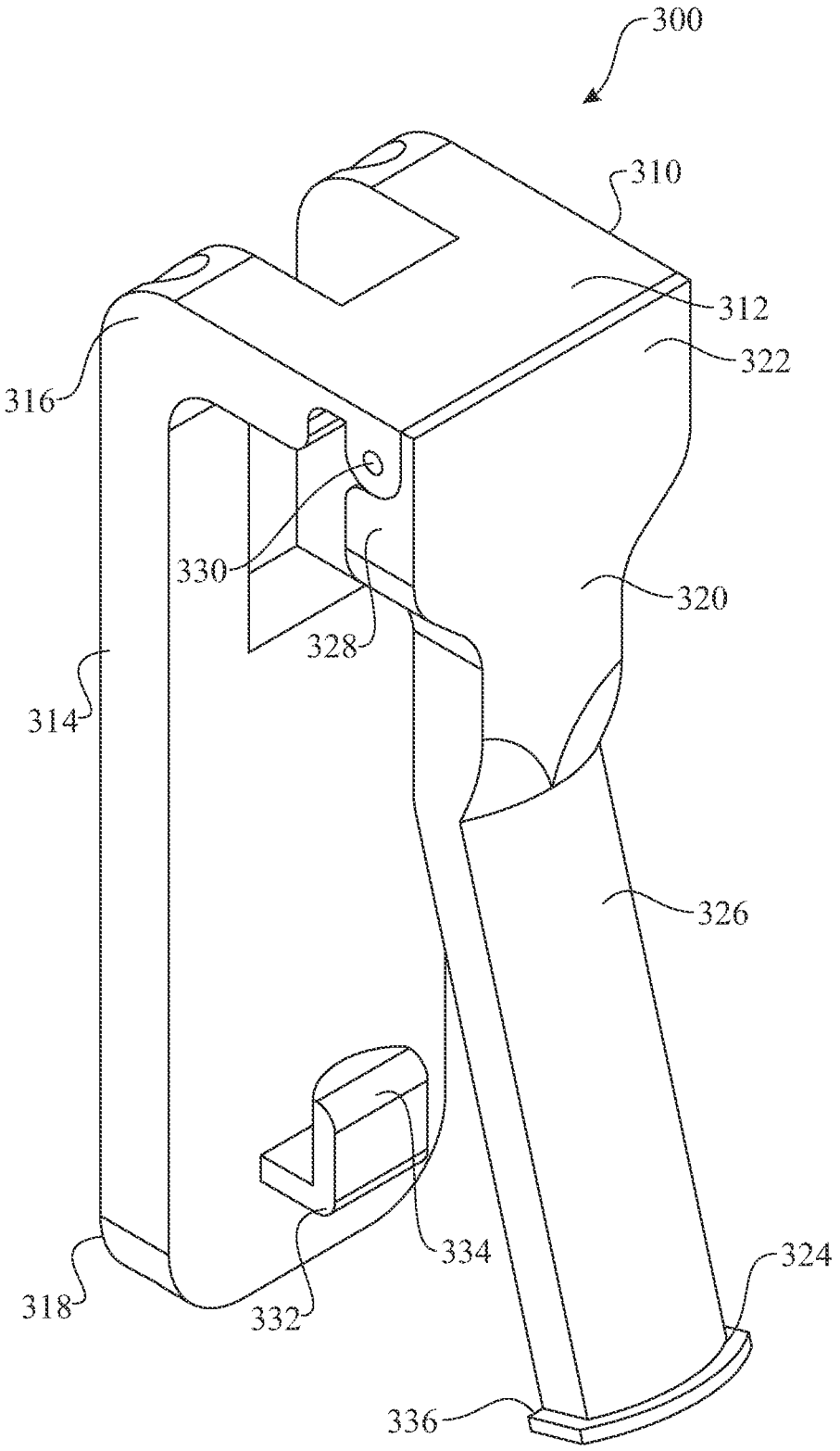
FIG. 8 presents an isometric view of a clip assembly in accordance with a second embodiment of the present invention.

FIG. 8 presents an isometric view of a clip assembly 300 in accordance with a second embodiment of the present invention. The clip assembly 300 may include a main body 310 which may consist of a top portion 312, a central portion 314 and a coupling member 320. The top portion 314 may couple the central portion 314 behind the coupling member 320. The central portion 314 may extend between an upper end 316 and a lower end 318. The upper end 316 may be curved for comfort against a wearers neck or skin.

The coupling member 320 may include an elongated body 326 that may encompass the entire length of the coupling member 320. The coupling member 320 may extend between a top end 322 and a bottom end 324, where the top end 322 may meet the top portion of the central portion 314. The elongated body 326 may be narrow, to fit within the folded fabric of a necktie. The bottom end 324 of the coupling member 320 may include a lip 336 which protrudes on a horizontal plane from the bottom end 324 but is flush against a backside of the coupling member 320. Thus the lip 336 may extend beyond a perimeter of the bottom end 324.

At the top end 322 of the coupling member 320 may be an attachment end 328. The attachment end 328 may couple the coupling member 320 to the main body 310 by a coupling means 330. The coupling means 330 may be a hinge or other rotational connection that fastens two rigid pieces together while also allowing for flexible movement back and forth as desired. When in an open position, first position or release position (as illustrated in the present figure) the coupling member 320 may be separated from the central portion 314 to receive a necktie 350 (further illustrated and explained in the following figures). In a closed position, second position or secure position (see FIGS. 12 and 13) the central portion 314 may be positioned towards the coupling member 320.

At the lower end 318 of the central portion 314 may be a securing device 332. The securing device 332 may be positioned on the central portion so that the securing device 332 faces the elongated body. 326. The securing device 332 may hook upwards to a securing end 334. As will be better illustrated in FIGS. 11 and 12, the securing device 332 may be positioned slightly higher than the lip 336 of the bottom end 324 when the central portion 314 and the elongated body 326 are adjacent to each other.

Figure 9:
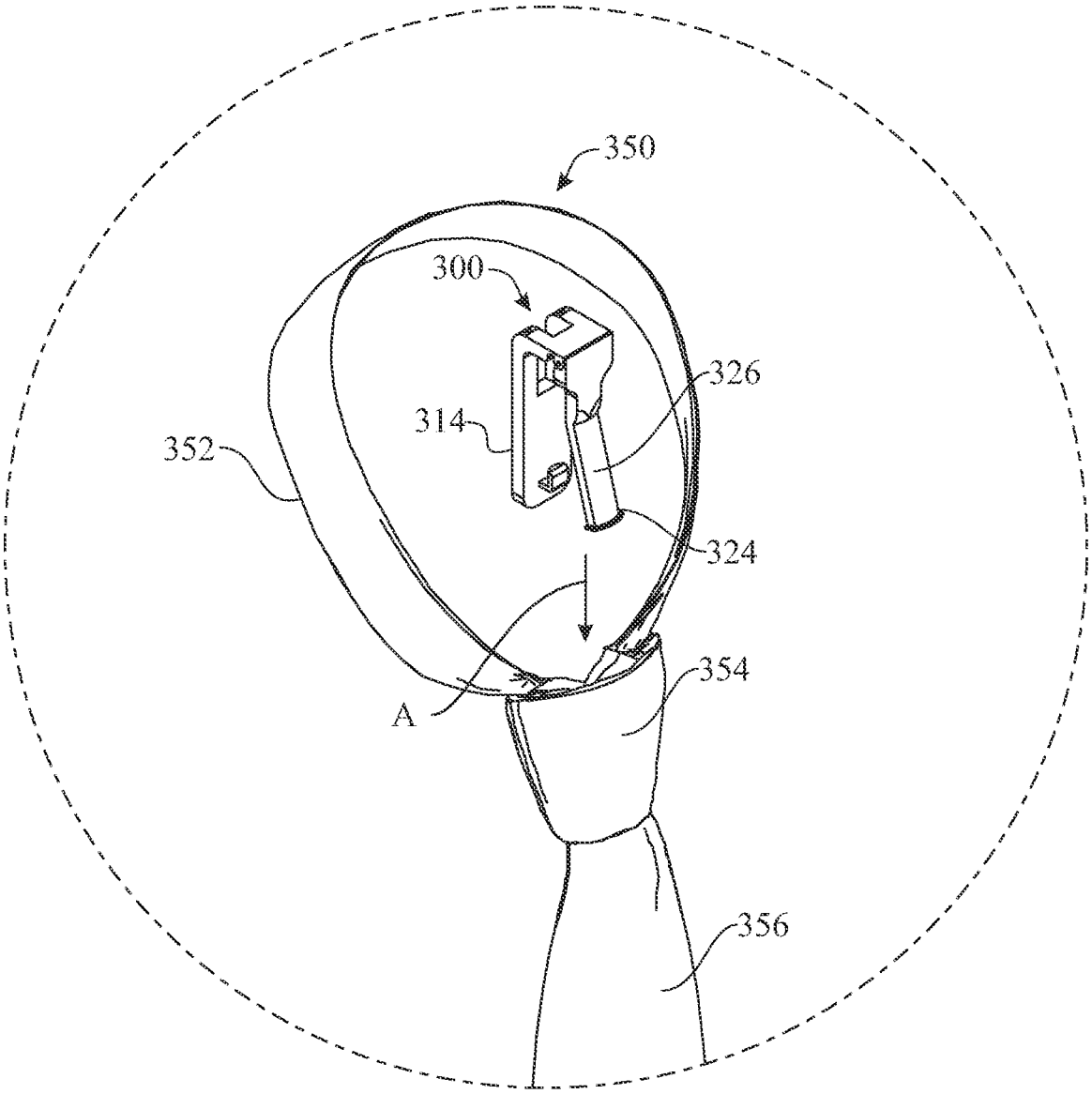
FIG. 9 presents an isometric view of the clip assembly of FIG. 8 on the necktie.
Figure 10:
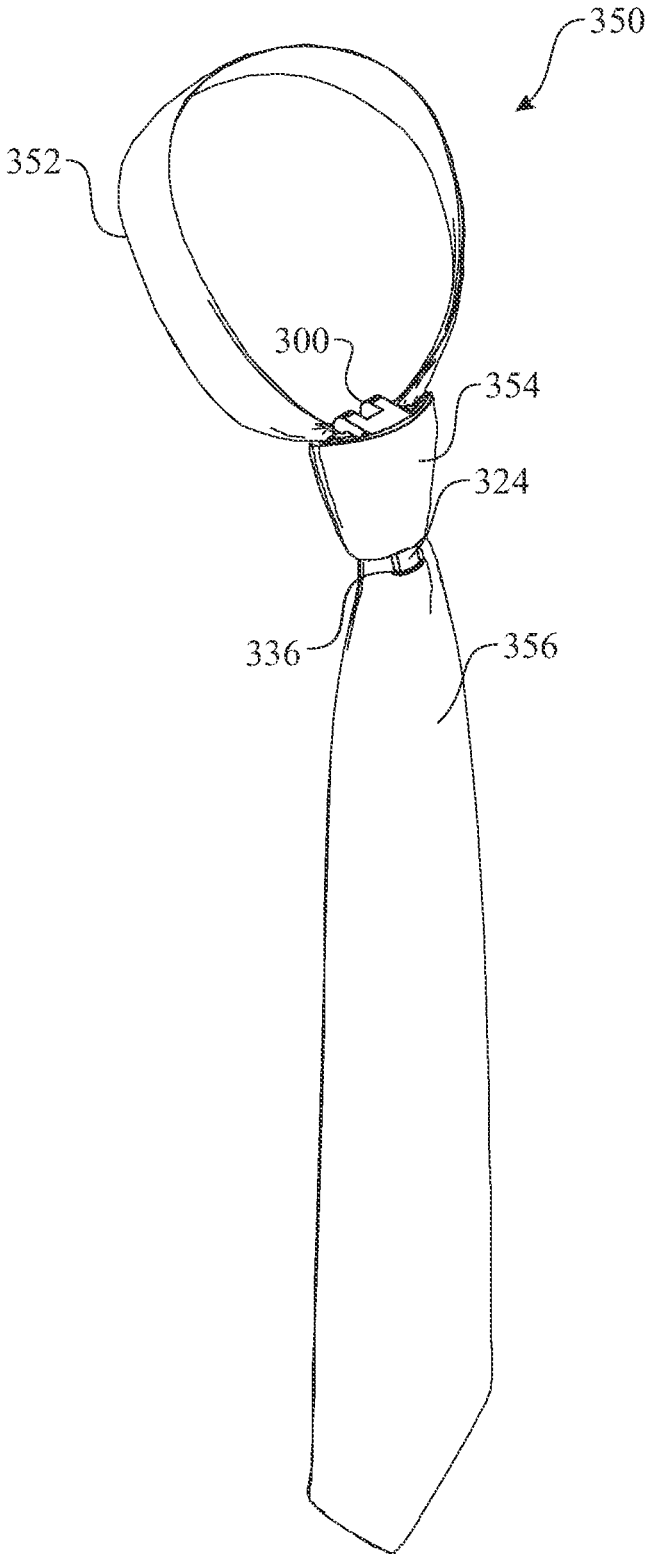
FIG. 10 presents an isometric view of the clip assembly of FIG. 8 coupled to a necktie.

Referring to FIG. 9 the clip assembly 300 is shown with a necktie 350. The necktie 350 may generally include the following parts; a neck portion 352, a knot 354, and an elongated portion 356. The clip assembly 300 may be positioned above the knot 354 and then pressed into the knot 354 as indicated by the downward arrow A. During use, the elongated body 326 may be separated from the central portion 314 to provide space between these parts to receive the knot 354 of the necktie 350. The bottom end 324 may be pressed into the knot 354 to engage the clip assembly 300 onto the neck tie 350. Once fully inserted into the knot 354, the bottom end 324 of the clip assembly 300 may extend beyond the knot 354 onto the elongated portion 356 of the necktie 350, thereby exposing the lip 336 beneath the knot 354 (see FIG. 10).

Figure 11:
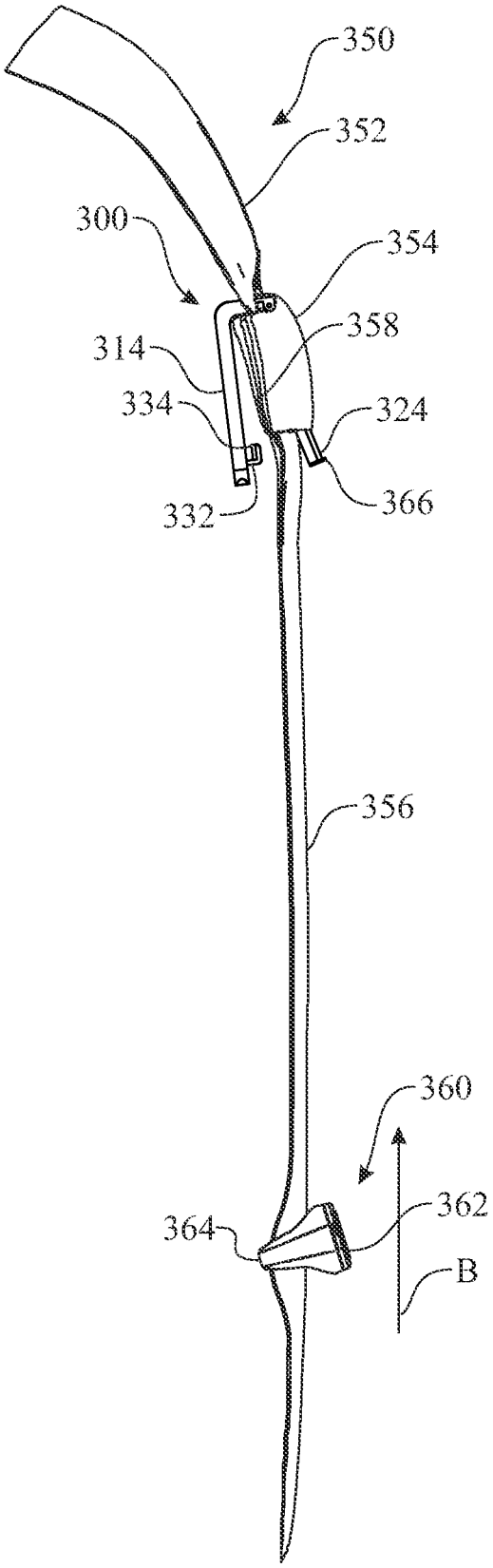
FIG. 11 presents a side view of the clip assembly of FIG. 8 with the necktie and with a looped item.

Referring to FIG. 11, a side view of the clip assembly 300 is shown engaged on the knot 354 of the necktie 350. The central portion 314 of the clip assembly 300 may rest against a backside 358 of the knot 354. The securing device 334 may be positioned below the knot 354, and the securing end 334 may hook upwards towards the backside 358 of the knot 354. The securing end 334 may be positioned slightly higher than the lip 336 on the horizontal plane.

Figure 12:
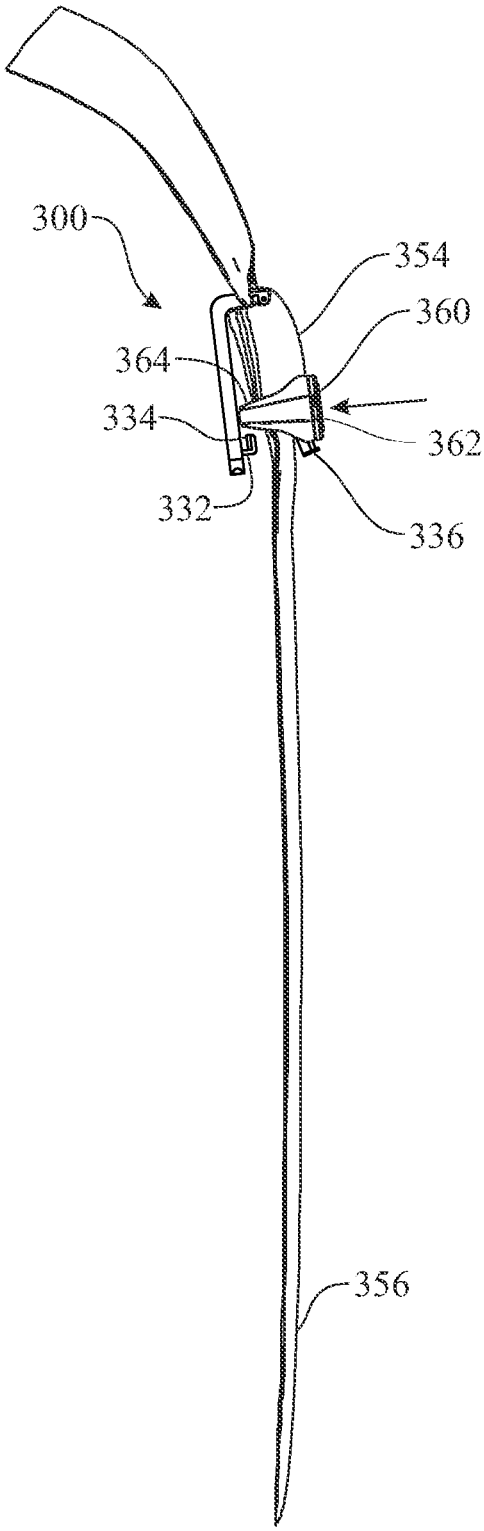
FIG. 12 presents a side view of the clip assembly of FIG. 8 coupled with the necktie and the looped item.
Figure 13:
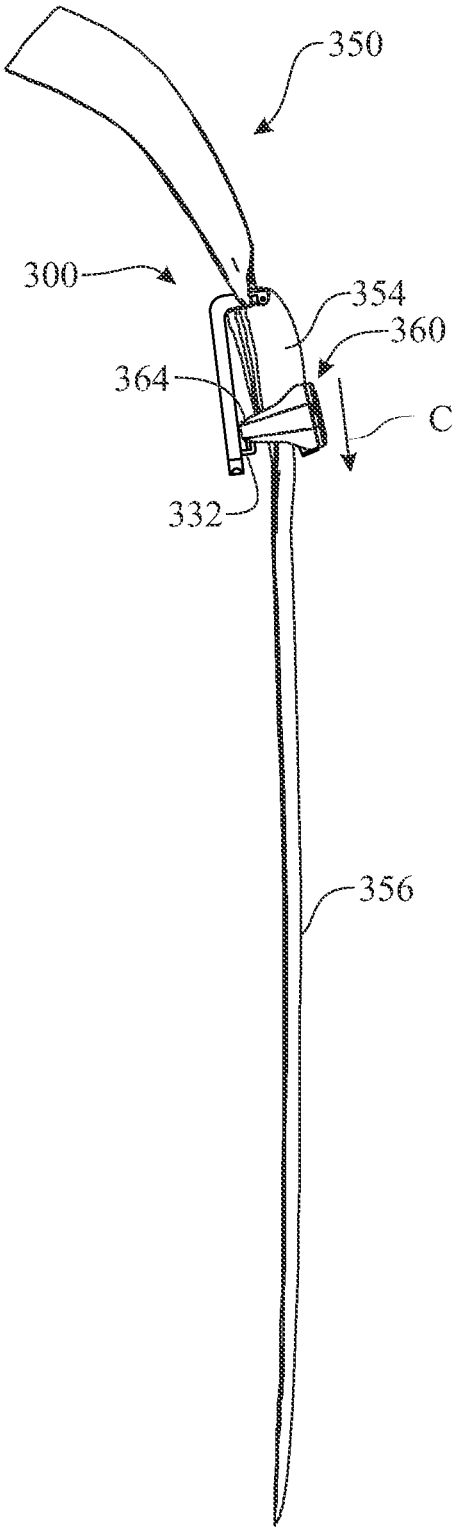
FIG. 13 presents a side view of the clip assembly of FIG. 8 coupled with the looped item and the necktie.

During use a looped item or ring 360 may slide along the elongated portion 356 of the necktie 350 in the direction of the upward arrow B to eventually meet the knot 354. The ring 360 may be a uniform band 364, or it may include a face 362 on the band 364. FIG. 12 shows how the ring 360 engages the clip assembly 300. The face 362 may rest atop the lip 336, when coupled to the clip assembly 300. Likewise, the band 364 may engage with the securing device 332 when the securing end 334 inserts into the band 364, as shown in FIG. 13. When the securing end 334 is positioned within the band 364, the ring 360 may be locked onto the clip assembly 300 so that it does not fall from the knot 354 onto the elongated portion 356 of the necktie 350. Thus, when the ring 360 is pressed down in the direction of arrow C, the securing end 334 of the securing device 332 inserts into the band 364. Similarly, when the face 362 is positioned atop the lip 336, the face 362 will not face downward and remains facing outward from the knot 354.

Figure 14:
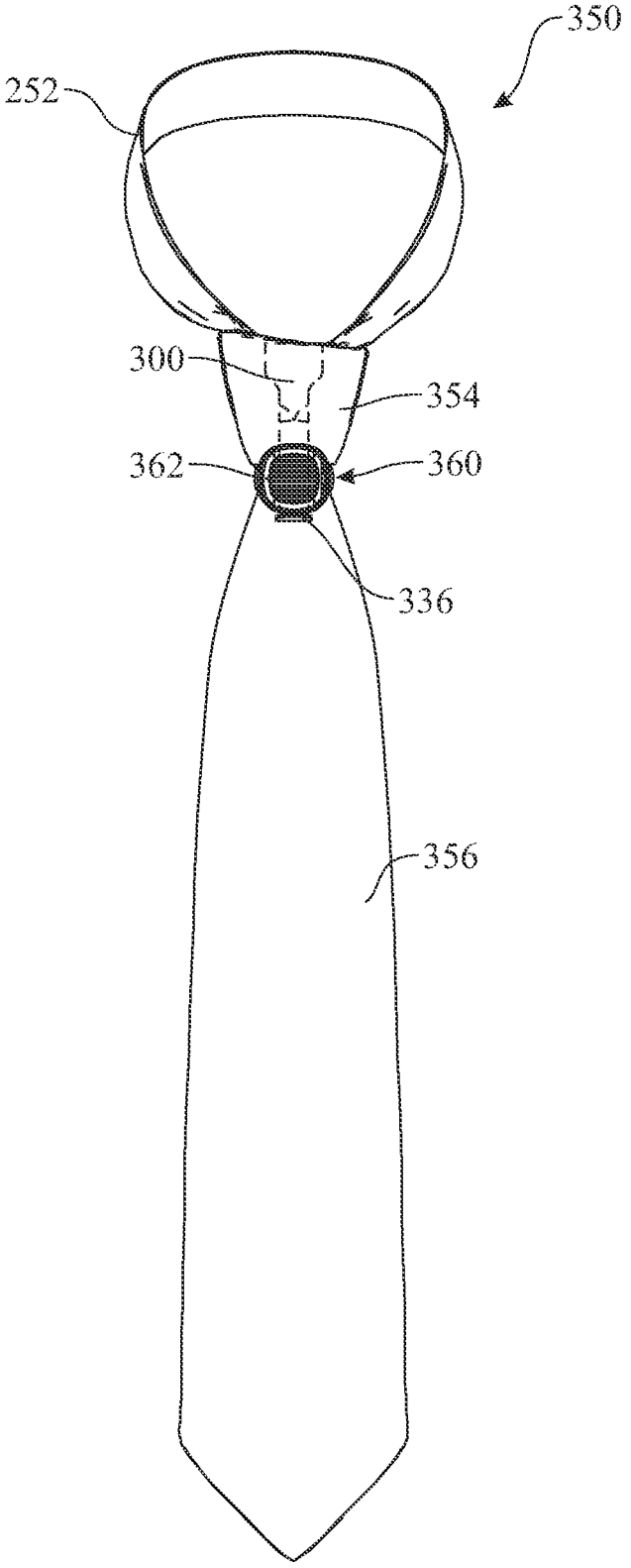
FIG. 14 presents a front view of the clip assembly of FIG. 8 coupled with the necktie and the looped item.

Referring to FIG. 14, a front view of the clip assembly 300 is shown with the ring 360 on the knot 354 of the necktie 350. The clip assembly 300 is illustrated in dotted lines to show the positioning behind the knot 354. The lip 336 may allow the face 362 of the ring 360 to face outward. The clip assembly 300 may provide an honorable display for a user's memorabilia, the Clip assembly 300 may prevent the ring 360 from sliding off the necktie 350 so that a wearer may proudly display their ring 360.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A clip assembly to fasten a looped item to a necktie comprising:

a main body, where the main body is comprised of two portions, a first portion and a second portion, where the first portion and the second portion engage a knot of the necktie;

a hinge pivotably securing the first portion and the second portion, where the hinge pivotably moves the first portion and the second portion between a first position, and a second position;

a securing portion affixed to the main body, where the securing portion fastens the looped item against a knot of the necktie;

a central portion comprising the first portion, where the central portion extends between an upper end and a lower end; and a coupling member comprising the second portion, where the coupling member extends between a top end and a bottom end.

2. The clip assembly of claim 1, wherein the central portion includes a securing device at the lower end, where the securing device faces the coupling member.

3. The clip assembly of claim 2, wherein the securing device includes a securing end, where the securing end hooks upward from the securing device.

4. The clip assembly of claim 1, wherein the coupling member includes a narrow elongated body, where the narrow elongated body inserts into the knot of the necktie.

5. The clip assembly of claim 1, where the bottom end of the coupling member includes a lip, where the lip protrudes beyond a perimeter of the bottom end.

6. The clip assembly of claim 5, where the lip is flush against a backside of the coupling member.

7. The clip assembly of claim 1, wherein the first portion is a plurality of wings extending from a central portion, and the second portion is a necktie coupling member pivotably coupled with the central portion.

8. The clip assembly of claim 7, wherein the securing portion comprises a looped item coupling member pivotably coupled with the central portion.

9. The clip assembly of claim 1, wherein the looped item is a ring.

10. The clip assembly of claim 1, wherein the first position is a release position.

11. The clip assembly of claim 1, wherein the second position is a secure position.

12. The clip assembly of claim 1, wherein the clip assembly is made from one of at least a metallic, plastic or polymer material.

13. A method of use for a clip assembly to secure a looped item to a knot of a necktie comprising the steps of:

positioning a main body of the clip assembly against the knot, where the main body includes a first portion and a second portion;

coupling the clip assembly to the knot by positioning the first portion against a backside of the knot, and engaging the second portion within the knot;

threading the necktie through a looped item;

sliding the looped item along an elongated portion of the neck tie to meet the knot;

inserting the looped item within the clip assembly in an open position, where the open position positions the first portion away from the second portion;

positioning a securing portion of the clip assembly against the looped item; and engaging the securing portion of the clip assembly against a band of the looped item where the securing portion prevents the looped item from sliding off the knot.

14. The method of use for the clip assembly of claim 13, further comprising the step of engaging the backside of the knot with the first portion, where the first portion includes a pair of wings extending from a central portion.

15. The method of use for the clip assembly of claim 13, further comprising the step of opening the clip assembly by pivotally moving the first portion away from the second portion.

16. The method of use for the clip assembly of claim 13, further comprising the step of resting the first portion against the backside of the knot, where the first portion includes a central portion extending between an upper end and a lower end, and inserting the second portion within the knot, where the second portion includes a coupling member extending between a top end and a bottom end along an elongated body.

17. The method of use for the clip assembly of claim 16, further comprising the step of locking the looped item onto the clip assembly, by engaging the looped item to the lower end of the central portion with a securing device.

18. A clip assembly to fasten a looped item to a necktie comprising:

a main body, where the main body is comprised of two portions, a first portion and a second portion, where the first portion is positioned against a backside of a knot of the necktie, and where the second portion inserts into the knot of the necktie;

a hinge pivotably securing the first portion and the second portion, where the hinge moves the first portion and the second portion between a first position, and a second position;

where the first position separates the first portion from the second portion to receive the knot of the necktie, and where the second position closes the first portion to be adjacent to the second portion when the knot is engaged; and a securing portion affixed to the main body, where the securing portion fastens the looped item against the knot of the necktie.

* * * * *